US005761898A

United States Patent [19]

Barnes et al.

[11] Patent Number: 5,761,898

[45] Date of Patent: Jun. 9, 1998

[54] TRANSITION PIECE EXTERNAL FRAME SUPPORT

[75] Inventors: John Eugene Barnes, Niskayuna; Rodger Orval Anderson; Charles Evan Steber, both of Scotia, all of N.Y.

[73] Assignee: General Electric Co., Schenectady, N.Y.

[21] Appl. No.: 690,954

[22] Filed: Aug. 1, 1996

Related U.S. Application Data

[63] Continuation of Ser. No. 359,495, Dec. 20, 1994, abandoned.

[51] Int. Cl.[6] ..... F02C 1/00

[52] U.S. Cl. ..... 60/39.32; 60/39.37; 60/722

[58] Field of Search ..... 60/39.31, 39.32, 60/39.75, 39.37, 722, 747, 752; 415/182.1

[56] References Cited

U.S. PATENT DOCUMENTS

| | | | |
|---|---|---|---|
| 2,511,432 | 6/1950 | Feilden | 60/39.32 |
| 2,547,619 | 4/1951 | Buckland . | |
| 2,594,808 | 4/1952 | Rubbra . | |
| 2,608,057 | 8/1952 | Boyd et al. . | |
| 2,748,567 | 6/1956 | Dougherty | 60/752 |
| 2,765,620 | 10/1956 | Egbert | 60/752 |
| 3,657,882 | 4/1972 | Hugoson . | |
| 3,750,398 | 8/1973 | Adelizzi et al. | 60/39.32 |
| 3,759,038 | 9/1973 | Scalzo et al. . | |
| 4,191,011 | 3/1980 | Sweeney et al. . | |
| 4,195,474 | 4/1980 | Bintz et al. . | |
| 4,232,527 | 11/1980 | Reider . | |
| 4,297,843 | 11/1981 | Sato et al. . | |
| 4,422,288 | 12/1983 | Steber . | |
| 4,465,284 | 8/1984 | Szema | 415/178 |
| 4,640,092 | 2/1987 | Coburn et al. | 60/722 |
| 4,785,623 | 11/1988 | Reynolds . | |
| 4,901,522 | 2/1990 | Commaret et al. . | |
| 5,190,245 | 3/1993 | Debeneix . | |
| 5,265,412 | 11/1993 | Bagepalli et al. . | |
| 5,414,999 | 5/1995 | Barnes | 60/722 |

FOREIGN PATENT DOCUMENTS

| | | | |
|---|---|---|---|
| 2422037 | 12/1979 | France | 60/752 |
| 2 258 719 | 6/1973 | Germany . | |
| 2 406 077 | 5/1979 | Germany . | |

*Primary Examiner*—Timothy Thorpe
*Assistant Examiner*—Ted Kim
*Attorney, Agent, or Firm*—Nixon & Vanderhye

[57] ABSTRACT

A transition piece for connection between a gas turbine combustor and a stage of the gas turbine, the transition piece being generally tubular and having an upstream end for connection to the gas turbine combustor and a downstream or aft end for connection to the turbine stage, the aft end defined by radially inner and outer sides, and wherein the aft end is formed with a peripheral rib extending about the end and wherein at least one of the radially inner and outer sides has an external frame support secured thereto and extending substantially completely between the opposite sides which provides resistance to external pressure at the aft end while permitting the transition piece to expand thermally.

15 Claims, 8 Drawing Sheets

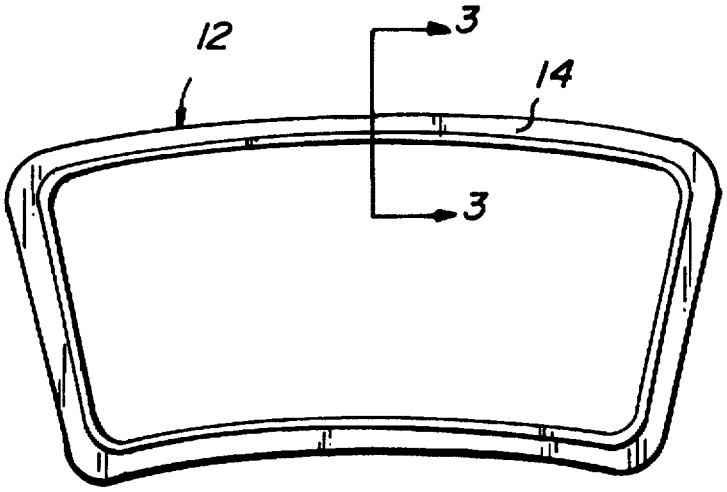
Fig. 2 (PRIOR ART)
Fig. 3 (PRIOR ART)
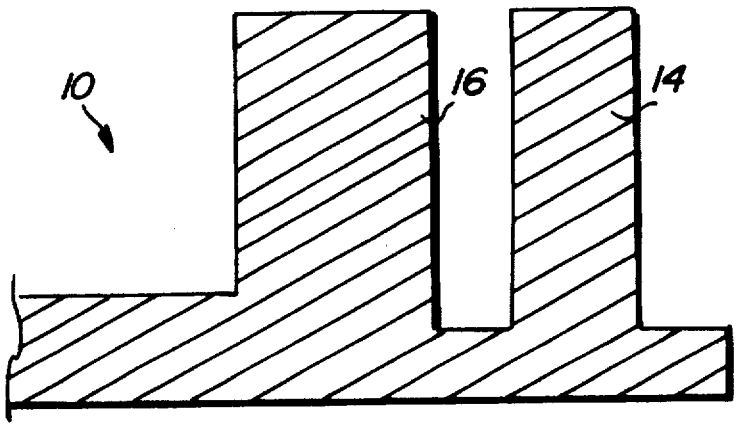

Fig. 4
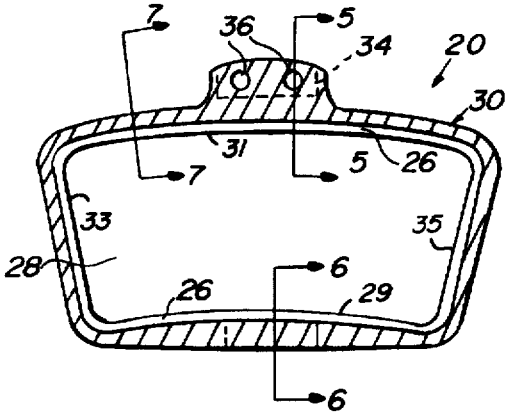
Fig. 5
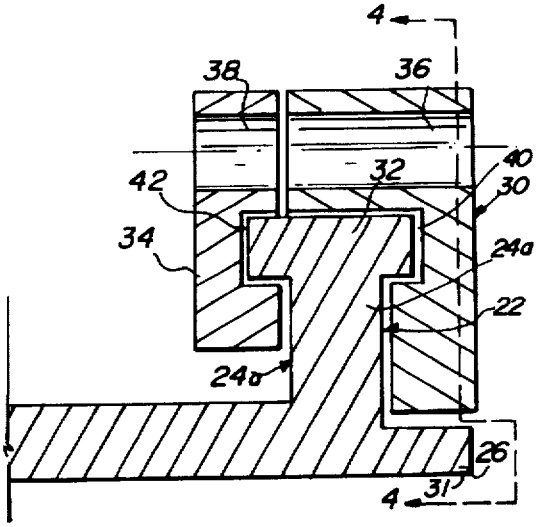
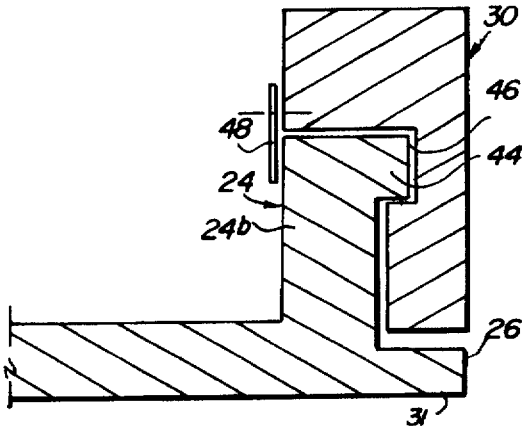
Fig.6
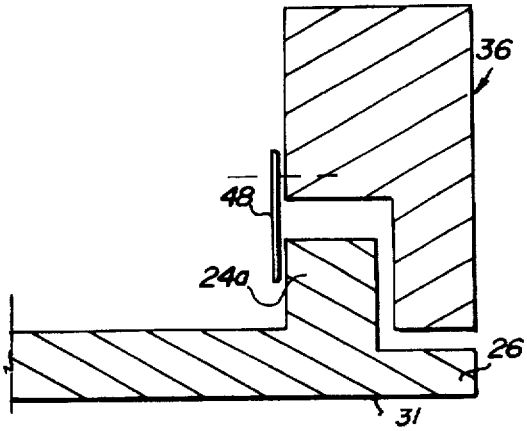
Fig. 7

TRANSITION PIECE EXTERNAL FRAME SUPPORT

TECHNICAL FIELD

This is a continuation of application Ser. No. 08/359,495 filed on Dec. 20, 1994, now abandoned.

This invention relates generally to gas turbine structural support systems with high thermal gradients combined with high mechanical loads which produce potentially unacceptably high stress levels. In particular, the invention relates to a redesign of the aft end of the transition piece of a gas turbine.

BACKGROUND

The transition piece in a gas turbine is a tubular member of compound shape which typically connects a combustor of the combustion system to the first stage of the turbine. In conventional systems, the aft mount of the transition piece, by which the transition piece is connected to the turbine stage, is welded to and protrudes from the transition piece body upstream of the aft end frame.

A well known problem with the gas turbine transition piece is the tendency for the aft end opening to deflect closed due to creep at high metal temperatures. This unwanted deflection is caused by higher pressure on the exterior than on the interior of the tubular transition piece. As may be recalled, the aft end of the transition piece must transition to an annular sector in order to pass hot combustion gas from the combustor to the turbine. This annular geometry is inherently weak against external pressure loading. The creep phenomenon is one of the design limits which determines the minimum number of combustors and maximum gas temperature for the gas turbine. An additional design limit is thermal stress fatigue cracking of the transition piece.

In a related, commonly owned application Ser. No. 08/147,295 (filed Nov. 5, 1993 and now U.S. Pat. No. 5,414,999), an integral strengthening frame is formed at the aft end of the transition piece. This thickened frame incorporates the mounting hardware for attaching the transition piece to the turbine stage. It was found, however, that simply making the aft end frame wall thicker increases thermal stresses and does not increase the operating life of the part.

With reference now to FIGS. 1–3, a conventional transition piece 10 is illustrated including an integral aft frame 12. The integral frame may include one to three or more ribs, and as shown, includes a pair of peripheral upstanding ribs 14, 16 (FIG. 3) extending about the aft end opening of the transition piece. Mounting hardware 18 is located upstream of the frame, but may be integrated with the frame in accordance with the '295 application. The ribs 14, 16 serve three functions:

1) structural stiffening of the aft end which, due to the annular geometric shape, is weak at resisting the external pressure on the transition piece;
2) attachment for labyrinth seals; and
3) increased cooling surface area.

As a result of the incorporation of such ribs, however, large thermal gradients exist in the ribs, causing large thermal stresses. Moreover, any increase in bending strength of the ribs (i.e., the rib section modulus), to better resist the pressure loading, causes an increase in thermal stress. Accordingly, the maximum allowable thermal stress limits the rib section modulus which, in turn, limits the circumferential span of the transition piece (i.e., the number of combustors for a given metal temperature). Current designs use the deepest rib that will not crack due to thermal fatigue while the rib width is limited by heat transfer and sealing concerns.

DISCLOSURE OF THE INVENTION

The invention herein, in general terms, involves attaching a structural, external frame to the aft end integral frame of the gas turbine transition piece. This has the advantage of being able to support the pressure load which otherwise causes the transition piece aft opening to deflect closed due to creep deformation, while not producing the undesirable high thermal stresses caused by rib stiffeners or increased wall thickness.

More specifically, in a first exemplary embodiment, the invention provides an external frame for surrounding the aft end integral frame of the transition piece, with attachments to the transition piece integral frame at the radially inner and outer mid-spans, thereby resisting the pressure tending to force the aft opening closed. This external frame is isolated from the hot combustion gas and thus operates at a much lower temperature than the transition piece itself.

In a second exemplary embodiment, the external frame is in the form of a pair of support bars attached along the radially outer and radially inner walls of an integral aft end frame, respectively. In each case, the support bar is secured to the aft end frame at a mid-span location by a clamp, while at remote ends, the bar is merely supported in saddles in a prestressed condition such that an outward force (away from the transition piece interior) is applied to the respective radially inner and outer walls to counteract the inwardly directed gas pressure during operation. In addition, by simply supporting (as opposed to clamping) the bars in saddles at their respective remote ends, the transition piece is free to expand thermally during operation.

In a third exemplary embodiment, the external frame is in the form of a support bar employed across the radially inner wall of the aft end integral frame in the manner described immediately above, but the radially outer wall of the aft end is provided with axially extending pins located mid-span and at the remote ends. These pins are designed to be received in a center hole and two end slots, respectively, formed in a nozzle retaining ring of the turbine stage. More specifically, the center pin of the transition piece is received within a complementary hole in the retaining ring while the outer pins are received within elongated slots in the retaining ring, again allowing the transition piece to expand thermally during use.

In a fourth exemplary embodiment, the radially inner wall of the transition piece aft end is reinforced by a support bar (rectangular cross section stock) clamped mid-span to the transition piece frame, and grooved at its opposite ends to receive saddles projecting from the transition piece.

Thus, in accordance with its broader aspects, the invention here relates to a tubular transition piece for connection between a gas turbine combustor and a stage of the gas turbine, the transition piece having an upstream end for connection to the gas turbine combustor and a downstream or aft end for connection to the turbine stage, the aft end having an opening defined by radially inner and outer walls and a pair of opposite side walls, and wherein the aft end is formed with a peripheral rib extending about the end opening and wherein at least one of the radially inner and outer walls has an external structural frame member secured thereto at a lateral mid-point of the one of the radially inner and outer walls and extending substantially completely between the opposite side walls.

Additional objects and advantages will become apparent from the detailed description which follows.

BRIEF DESCRIPTION OF THE DRAWINGS

FIG. 2 is a front elevation of the aft end frame portion of the transition piece illustrated in FIG. 1;

FIG. 3 is a cross section taken along the line 3—3 of FIG. 2;

FIG. 4 is a front elevation of the aft end frame of a transition piece in accordance with this invention;

FIG. 5 is a section taken along the line 5—5 of FIG. 4;

FIG. 6 is a partial section taken along the line 6—6 of FIG. 4;

FIG. 7 is a partial section taken along the line 7—7 of FIG. 4;

BEST MODE FOR CARRYING OUT THE INVENTION

Figure 1:
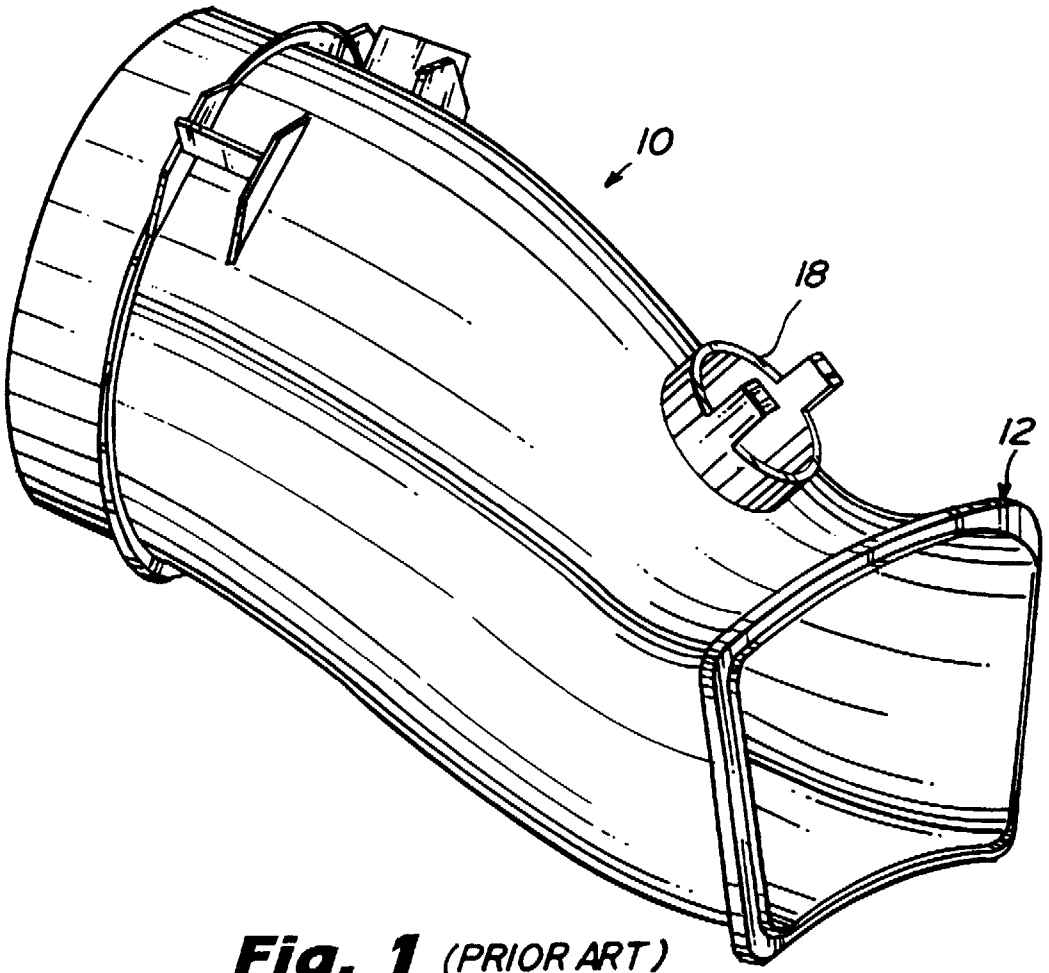
Fig. 1 (PRIOR ART)
FIG. 1 is a perspective view of a conventional gas turbine transition piece incorporating an aft end frame and mounting hardware located upstream of the aft end frame.

Turning to FIGS. 4 through 7, a new transition piece aft end design is shown in accordance with a first exemplary embodiment of the invention.

The generally tubular transition piece 20 is formed with an integral aft end frame 22 which includes an upstanding peripheral rib 24, adjacent the downstream edge 26 of the aft end frame. The aft end frame 20 and the upstanding rib 24 extend completely around the aft end opening 28. An external frame 30 also surrounds the aft end frame opening 28, and is secured to the upstanding rib 24 of the transition piece as described below. For convenience, and with specific reference to FIG. 4, the lower wall 29 of the aft end of the transition piece as viewed in the Figures is regarded as the radially inner wall while the upper wall 31 is regarded as the radially outer wall, relative to a horizontal, longitudinal axis of the turbine rotor about which the combustors and associated transition pieces are arranged. The radially inner and outer walls 29, 31 are connected by side walls 33, 35.

The rib 24 is formed with a mounting flange 32 extending in upstream and downstream directions from the rib 24, but only at a mid-span location of the radially outer wall **24*a* of the rib 24. Here, the frame 30 is fixed to the rib 24 and flange 32 via a clamp 34 and a pair of associated bolts (not shown) extending through pairs of aligned bolt holes 36, 38 (one pair shown in FIG. 5). Flange 32 is received within mating grooves 40, 42 provided in the frame 30 and clamp 34**, respectively.

At the same time, the radially inner wall **24*b* of the rib 24 is formed with a forwardly projecting hook 44 which is received within a mating groove 46 formed in the frame 30 in the mid-span region of the radially inner side wall 24*b* of the rib 24**.

The remaining peripheral area of the external frame 30 has a cross section as shown in FIG. 7 and thus permits room for thermal expansion. Conventional face style labyrinth seals 48 may be used between the transition piece and the turbine first stage nozzle, but other seal arrangements are contemplated as well. In any event, some flow of air similar to the amount that currently leaks through the seals is required in the gap between the transition piece rib 24 and the external frame 30.

The above described embodiment increases the bending strength of the transition piece aft end without necessarily also increasing the thermal stresses associated with a rib stiffener or increased wall thickness. The clamping arrangement only at the mid-span of the radially outer wall **24*a* constrains all degrees of freedom between the transition piece 20 and the external frame 30. The radially inner connection along wall 24*b* provides constraint only between radial degrees of freedom of the transition piece 20 and external frame 30. At the same time, the frame 30 is nevertheless isolated from the hot combustion gases. As a result, the frame 30 operates at much lower temperature than the transition piece 20, and thus is not subject to creep deformation. Moreover, by being attached to the transition piece 20 with minimal constraints, the hot transition piece 20 can thermally expand inside the frame 30** without creating high thermal stresses.

Figure 8:
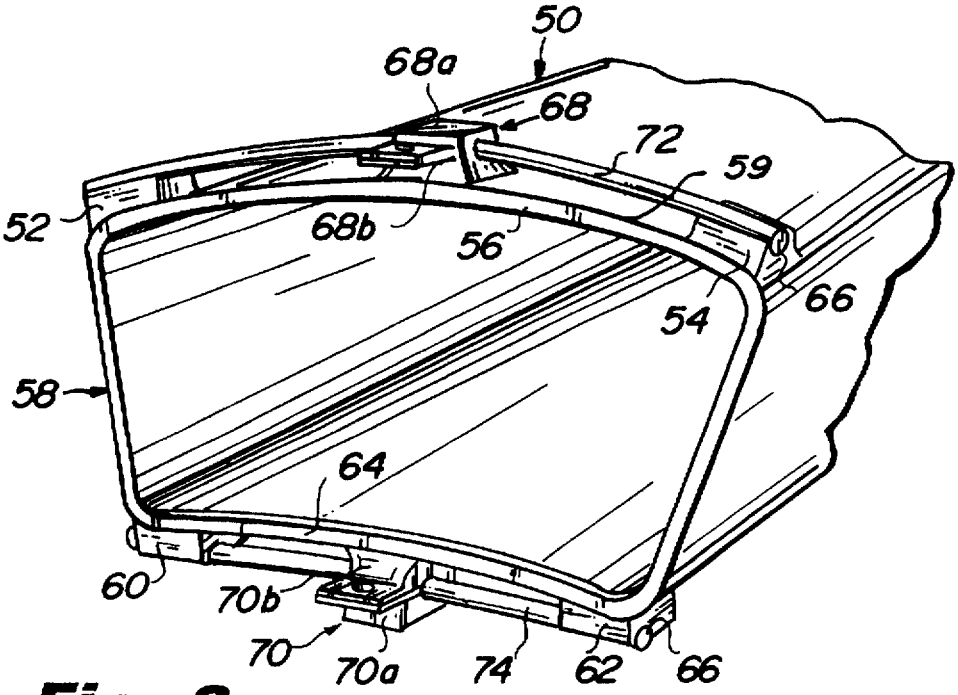
FIG. 8 is a partial perspective view of a gas turbine transition piece in accordance with a second exemplary embodiment of the invention.

Turning now to FIG. 8, another exemplary embodiment is illustrated. In this case, the transition piece 50 is fitted with saddle supports 52 and 54 at opposite ends of the radially outer wall 56 of the integral aft end frame 58 (which includes peripheral rib 59), and similar supports 60 and 62 at opposite ends of the radially inner wall 64. Each saddle support is formed with a rod receiving groove 66 extending transverse to the longitudinal axis of the combustor.

In addition, clamps 68 and 70 are welded to the wall 56, 64, respectively, each clamp having upper and lower elements **68*a*, *b* and 70*b*, *a*, respectively, which include "half" grooves permitting external frame components or support rods 72, 74** to be clamped therebetween as described further below.

Figure 9:
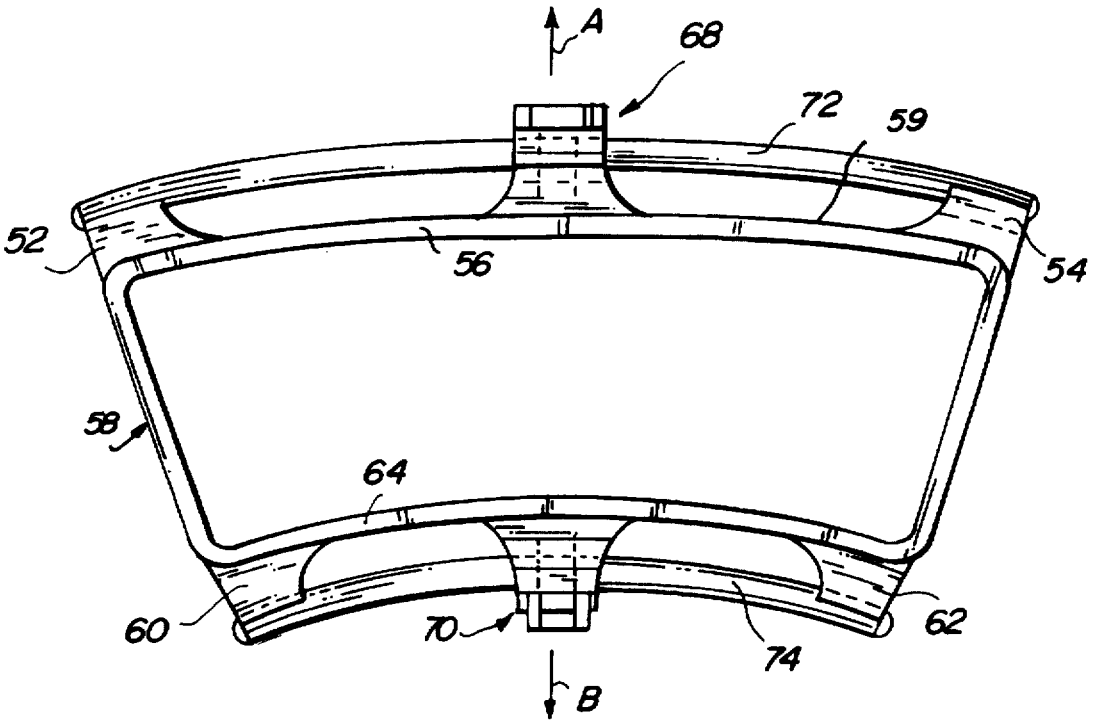
FIG. 9 is a front elevation of the aft end frame of the transition piece illustrated in FIG. 8.

The support bar or rod 72 is prestressed and clamped between elements **68*a* and *b*** such that an outward force is exerted on the mid-section of the transition piece, as indicated by arrow A in FIG. 9. This outward force counteracts the outside gas pressure during operation.

Similarly, a prestressed support bar 74 is clamped between elements **70*a*, *b* to provide a similar effect on the radially inner wall of the transition piece, causing a force to be exerted on the mid-section of the radially inner wall, indicated by arrow B. By allowing the rods 72, 74 to slide in the saddles 52, 54 and 60, 62, respectively, the transition piece 50** is free to expand thermally during operation.

Figure 10:
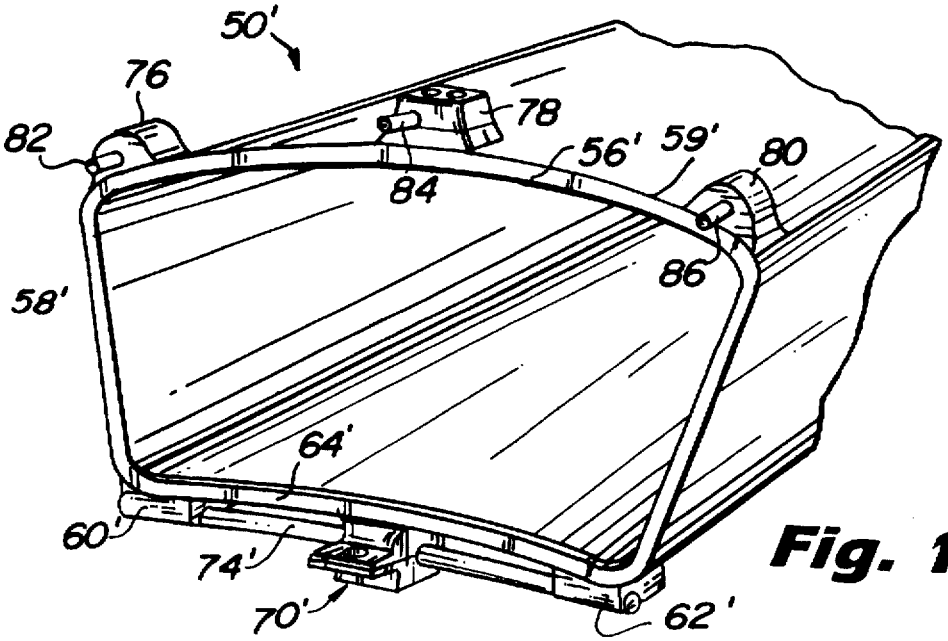
FIG. 10 is a partial perspective of the aft end of the transition piece in accordance with a third exemplary embodiment of the invention.
Figure 11:
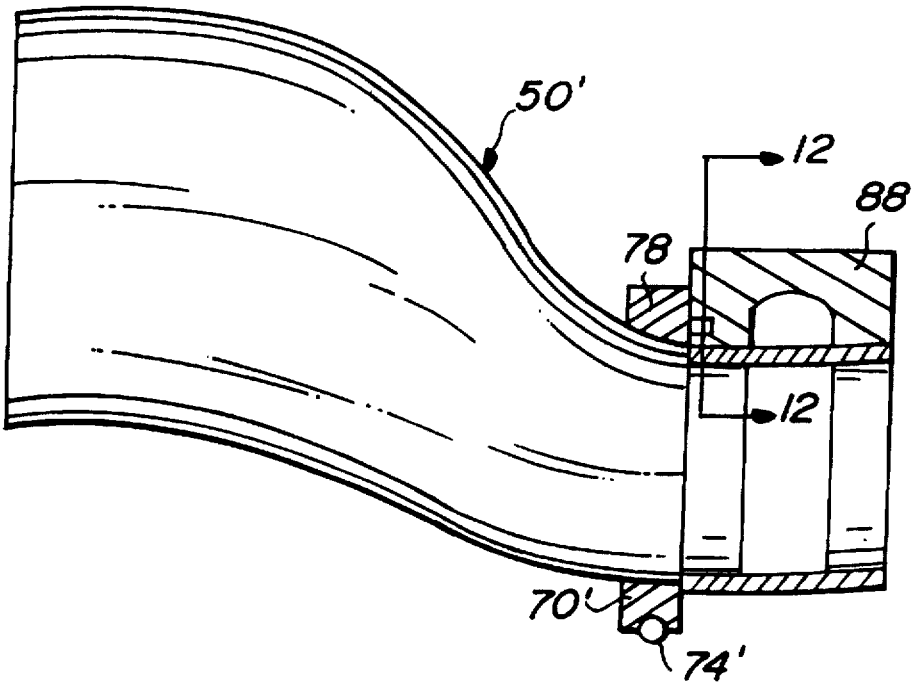
FIG. 11 is a side elevation of a gas turbine transition piece and associated turbine stage in accordance with the embodiment of FIG. 10.
Figure 12:
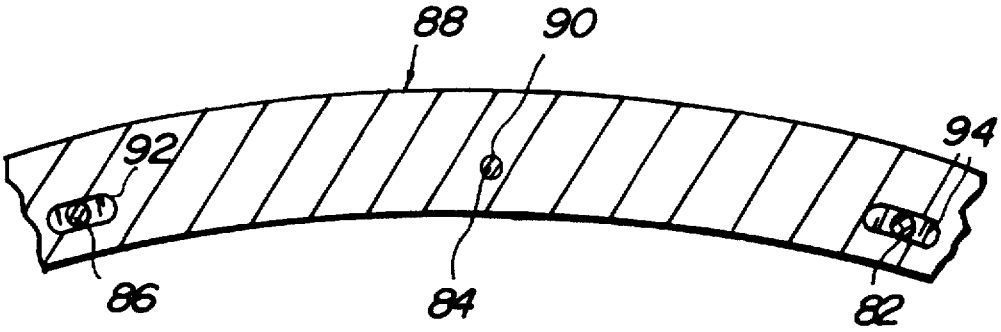
FIG. 12 is a partial section taken along the line 12—12 of FIG. 11.

FIGS. 10–12 illustrate yet another embodiment of the invention which is similar in some respects to the embodiment shown in FIGS. 7–9. In fact, the radially inner wall 64' of the frame 58'(including peripheral rib 59') of the transition piece 50' is provided with a support rod 74' and associated saddles 60', 62' and clamp 70' which are essentially identical to the arrangement shown in FIGS. 7–9. The radially outer wall 56' of the transition piece 50', however, is formed with projecting bosses 76, 78 and 80, each having an axially projecting pin 82, 84 and 86, respectively. These pins are adapted to seat in openings formed in a nozzle retaining ring 88 fixed to the first turbine stage. As best appreciated from FIGS. 11 and 12, the retaining ring 88 is formed with a round hole 90 for receiving the pin 84, and slots 92 and 94, adapted to receive pins 82 and 86. Slots 92 and 94, like the saddles 60', 62', allow the transition piece 50' to expand thermally during operation.

Figure 13:
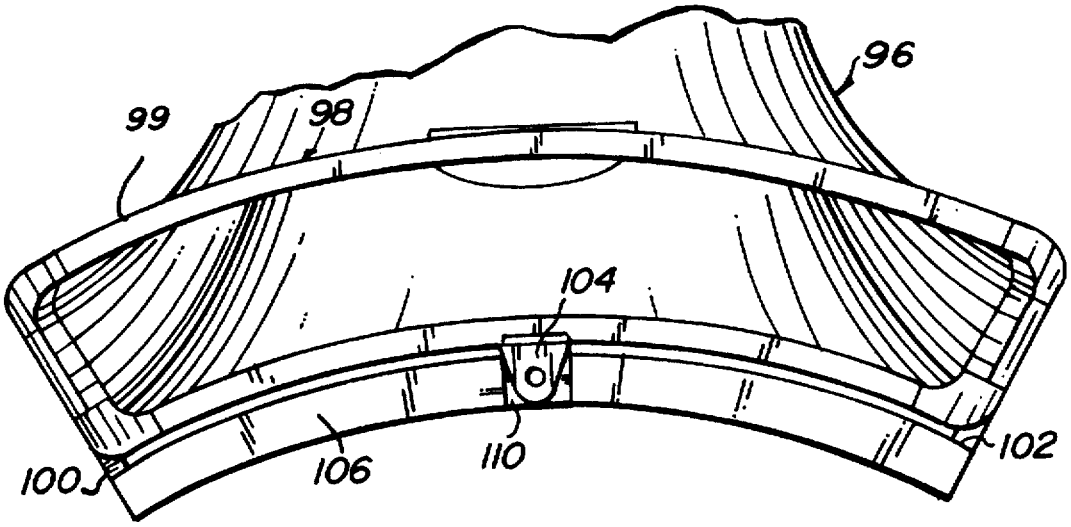
FIG. 13 is a partial front elevation of a gas turbine transition piece in accordance with a fourth exemplary embodiment of the invention.
Figure 14:
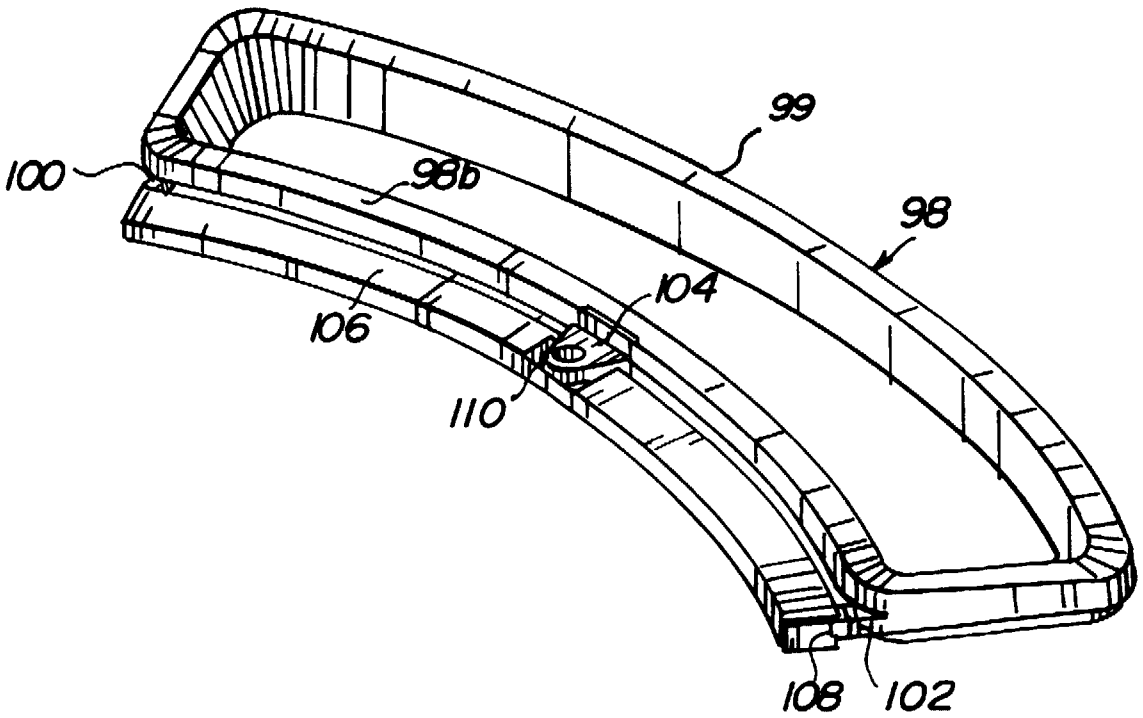
FIG. 14 is a perspective view of the aft end frame of the transition piece illustrated in FIG. 13.

FIGS. 13 and 14 illustrate a final embodiment of the invention, wherein an external support rod is applied only to the radially inner wall of the transition piece aft end integral frame. Specifically, the transition piece 96 has an aft end integral frame 98 which includes a peripheral rib 99 to which is welded a pair of end projections 100 and 102 and a center boss or mounting flange 104. An external frame member or arcuate support rod 106 (of preferably rectangular cross section) is formed with grooves 108 at opposite ends thereof (only one shown), adapted to receive projections 100 and 102. At the same time, mounting flange 104 is received in a center recess 110 in the support rod 106, allowing the rod to be securely bolted in place, in radially spaced relationship to the radially inner wall **98*b* of the integral frame 98. Here again, the opposite ends of the rod are free to slide relative to the projections 100 and 102, allowing for thermal expansion of the transition piece 96**.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A tubular transition piece for connection between a gas turbine combustor and a stage of the gas turbine, the transition piece having an upstream end for connection to the gas turbine combustor and a downstream or aft end for connection to the turbine stage, the aft end having an opening defined by radially inner and outer walls and a pair of opposite side walls, and wherein the aft end is formed with a peripheral rib extending about the end opening and wherein at least one of said radially inner and outer walls has an external structural frame member fixedly secured thereto only at a lateral mid-point of said one of said radially inner and outer walls and extending substantially completely between said opposite side walls, said exterior structural frame member providing resistance to external pressure at said aft end while permitting said transition piece to expand thermally.

2. The transition piece according to claim 1 wherein said frame is external to said transition piece and extends completely about the periphery of the aft end.

3. The transition piece of claim 1 wherein said external frame is rigidly fixed to said peripheral rib only at a mid-span location of said radially outer side, thereby permitting the transition piece to expand thermally with respect to said external frame.

4. The transition piece according to claim 1 wherein said frame is integral with said aft end and includes a first support rod attached thereto and extending along said radially inner side and a second support rod attached thereto and extending along said radially outer side.

5. The transition piece of claim 3 wherein said first and second support rods are prestressed to exert outwardly directed forces on said transition piece.

6. The transition piece of claim 2 wherein each of said first and second support rods is rigidly clamped to the respective radially inner and outer sides.

7. The transition piece of claim 3 wherein each support rod is slidably supported at opposite ends thereof in saddles affixed to the respective radially inner and outer sides, thereby permitting the transition piece to expand thermally.

8. The transition piece according to claim 1 wherein said peripheral rib is integral with said aft end, and wherein said external structural frame member comprises a prestressed support rod affixed to substantially a lateral mid-point of said radially inner wall, and further wherein said support rod is slidably supported at remote ends thereof.

9. The transition piece of claim 4 wherein said radially outer side is adapted to be supported by a retaining ring on the stage of the gas turbine.

10. The transition piece of claim 9 wherein said radially outer side includes a first axially oriented pin adapted to be engaged by a complementary hole in said retaining ring at a mid-span location, and wherein said radially outer side also includes second and third axially oriented pins at remote ends thereof which are adapted to be engaged in elongated slots in said retaining ring.

11. A transition piece for connection between a combustor and a stage of a gas turbine, said transition piece having an upstream end adapted for connection to the combustor and a downstream end adapted for connection to the stage of the gas turbine; said downstream end having an opening defined by radially inner and outer walls and opposite side walls, said opening surrounded by an integral frame including a peripheral rib extending at least about said radially inner and outer walls of said integral frame; an external structural frame member connected to one of said radially inner and outer walls and extending substantially completely between said opposite side walls, said external structural frame member fixedly secured only at one location along a length dimension of said external frame member to thereby provide structural support to said transition piece against external pressure but to permit relative movement between said transition piece and said external structural frame member due to thermal expansion of said transition piece.

12. The transition piece of claim 11 wherein said external structural frame member is secured to said radially inner wall of said integral frame.

13. The transition piece of claim 12 wherein said external structural frame member is secured substantially at a mid-point of said radially inner wall.

14. The transition piece of claim 13 wherein said radially inner wall is formed with depending projections, and wherein said external structural frame member is formed with grooves at opposite ends thereof arranged to slidably receive said projections.

15. The transition piece of claim 14 wherein said integral frame is formed with a mounting flange at said mid-point and said external structural frame member is formed with a recess receiving said mounting flange.

* * * * *